US010845137B2

(12) United States Patent
Barreto et al.

(10) Patent No.: US 10,845,137 B2
(45) Date of Patent: Nov. 24, 2020

(54) COMBUSTION CLEANING SYSTEM AND METHOD

(71) Applicant: Vincent P. Barreto, Grain Valley, MO (US)

(72) Inventors: Vincent P. Barreto, Grain Valley, MO (US); Jordan P. Barreto, Grain Valley, MO (US)

( * ) Notice: Subject to any disclaimer, the term of this patent is extended or adjusted under 35 U.S.C. 154(b) by 0 days.

(21) Appl. No.: 16/700,920

(22) Filed: Dec. 2, 2019

(65) Prior Publication Data

US 2020/0173743 A1 Jun. 4, 2020

Related U.S. Application Data

(60) Provisional application No. 62/773,303, filed on Nov. 30, 2018.

(51) Int. Cl.

| | |
|---|---|
| ***F28G 11/00*** | (2006.01) |
| ***F28G 15/00*** | (2006.01) |
| *B08B 7/00* | (2006.01) |

(52) U.S. Cl.

CPC ..... *F28G 11/00* (2013.01); *F28G 15/003* (2013.01); *B08B 7/0007* (2013.01)

(58) Field of Classification Search

None

See application file for complete search history.

(56) References Cited

U.S. PATENT DOCUMENTS

| | | | | |
|---|---|---|---|---|
| 4,421,067 | A | 12/1983 | Krowech | |
| 6,935,281 | B2 | 8/2005 | Ruegg | |
| 8,246,751 | B2 | 8/2012 | Zhang | |
| 8,448,611 | B2 | 5/2013 | Dean | |
| 2009/0120336 | A1 | 5/2009 | Chapin | |
| 2009/0293817 | A1 | 12/2009 | Dean | |
| 2009/0320439 | A1 | 12/2009 | Chapin | |
| 2012/0067370 | A1* | 3/2012 | Crock | B08B 9/043 134/6 |
| 2012/0073611 | A1 | 3/2012 | Zhang | |
| 2013/0104929 | A1 | 5/2013 | Zhang | |
| 2017/0261275 | A1 | 9/2017 | Nilsson | |

OTHER PUBLICATIONS

Ziaul Huque, Experimental Investigation of Slag Removal Using Pulse Detonation Wave Technique, DOE/HBCU/OMI Annual Symposium, Miami, Fla., Mar. 16-18, 1999.

K. Hanjalić, 21 Smajević, Detonation-Wave Technique for On-Load Deposit Removal in Coal-Fired Boilers. See attached. Delft University of Technology, NI / NSU Novosibirsk, Elektroprivreda BH / University of Sarajevo (Keynote Lecture) VIII (Combustion of solid fuel). Nov. 13-16, 2012, Novosibirsk, Rusija.

* cited by examiner

*Primary Examiner* — Eric W Golightly

(74) *Attorney, Agent, or Firm* — Arthur K. Shaffer; Intellectual Property Center, LLC

(57) ABSTRACT

The present invention is directed to an improved mobile combustion cleaning system for removing debris from a plurality of semi-permeable heat exchange surfaces with a moveable distribution network configured for receipt of a combustion mixture from a mobile cart according to a configurable controller the configurable controller generating the impulse wave from the combustion mixture and for moving the moveable distribution network along a plurality of axes in response to a change in pressure.

9 Claims, 5 Drawing Sheets

COMBUSTION CLEANING SYSTEM AND METHOD

CROSS-REFERENCE TO RELATED APPLICATION

This application claims the benefit of the prior filed U.S. provisional application No. 62/773,303 filed Nov. 30, 2018 which is incorporated herein by reference.

FIELD OF THE INVENTION

The present invention is broadly directed to an industrial cleaning system and more particularly, to an mobile combustion cleaning system with an improved combustion distribution network which is portable and provides for an improved method for cleaning heat transfer surfaces.

BACKGROUND OF THE INVENTION

Industrial heating equipment often utilizes steam produced using heat exchange surfaces for exchanging heat from one source to another, which can then be used to provide steam for providing supply power. Burning of hydrocarbon fuels to produce high pressure steam can result in slagging and fouling of downstream heat transfer surfaces due to the bi-products of the combustion process. In addition, the primary sources of waste heat in industrial facilities include exhaust gases from fossil fuel-fired furnaces, boilers, and process heating equipment. Heat recovery steam generators (HRSG) in gas fired combined cycle plants thought to burn "clean" that do not employ an on-line cleaning system can also foul due to excessive corrosion, sulfide salts and other constituents that may precipitate out of the process gas stream. The heat exchange source may include a combustor that burns fuel in order to generate heat, which is then transferred into to the steam via a heat exchanger.

As heat transfer surfaces are layered with or blocked by deposits the efficiency of transfer of heat can decrease. As the heat transfer surfaces continue to foul, the mass loading of the deposits can also restrict and redirect flow patterns.

In addition, some industrial processes utilize flue gasses that may include contaminates or other deposits which must be removed from the gas during or after use before being released from the process. The flue gas and burnt fuel may generate residues that can be left behind on the surface of the combustor or heat exchanger. As a result, buildups of soot, ash, slag, or iron oxide mill scale on various surfaces and/or structures which can become fouled and inhibit the transfer of heat and therefore decrease the efficiency of the system. Periodic removal of such built-up deposits maintains the efficiency of the industrial systems.

In the past, pressurized steam, water jets, acoustic waves, and mechanical hammering have been used to remove this buildup. Some of these are designed for being permanently attached to the vessel and operated while the system is operational. In addition, these solutions can also be expensive to operate and cause erosion or destruction to the heat transfer surfaces. Because of the potential destruction caused by some of these solutions, their use is restricted and infrequent. Infrequent and ineffective operation of the cleaning devices or non-existent cleaning devices can result in fouling of the on-line cleaning devices, or the heat recovery steam generators (HRSG), adding to maintenance costs and leading to unplanned outages.

In addition, offline forms of cleaning such as high pressure water washing, which generates a large amount of hazardous waste water and dry ice blasting which is slow and cumbersome, are unable to reach deep into the tube bundles and provide minimal operational improvement while indiscriminate blasting created by repeatedly inserting and igniting bags inflated with a combustible mixture of gas and pure oxygen provide high intensity detonations that expose the entire structure to potentially damaging pressure waves while adding highly elevated safety concerns for personnel.

There have, of course, been many attempts to solve the inherent problems associated with industrial cleaning systems, however, many suffer from the same difficulties as previously mentioned. Therefore, there exists a need for an improved combustion cleaning system which is mobile and at least partially addresses some of the above-mentioned shortcomings.

SUMMARY OF THE INVENTION

In one embodiment, the present invention includes an mobile combustion cleaning system for removing debris from a plurality of semi-permeable heat exchange surfaces by transmitting a shaped impulse wave a depth into the semi-permeable heat exchange surface for removing debris, the system comprising a mobile cart with a configurable controller and a power supply; said configurable controller programmed with parameters for mixing and combusting a pressurized supply of fuel and air; a navigational controller in electrical communication with said power supply; said pressurized supply of fuel and air transmitted through said mobile cart to a distribution network; said distribution network comprising a mixing valve in electrical communication with said configurable controller for receiving and mixing said pressurized supply of fuel and air; an ignitor in electrical communication with said configurable controller for programmed ignition of said pressurized supply of mixed fuel and air whereby an impulse wave is generated; a navigation network in communication with said navigation controller for moving said distribution network around the heat exchange surfaces; and an outlet for transmitting said impulse wave onto the heat exchange surfaces whereby debris on the semi-permeable heat exchange surfaces is at least partially removed.

The invention also includes a method for cleaning a plurality of heat exchange surfaces; said method comprising: analyzing the utility area surrounding a plurality of heat exchange surfaces; mapping a route for moving a distribution network around the plurality of heat exchange surfaces based on a plurality of positions; configuring said distribution network and a navigation network; move said distribution network to a first position of said route; programming an impulse wave cycle into a configurable controller in communication with said distribution network; mixing a supply of pressurized fuel and air for transmission through said distribution network; generating an impulse wave by igniting said mixture from said mixing step based on a command received from said configurable controller; transmitting said impulse wave through said distribution network to an outlet; measure pressure at said outlet; continue generating an impulse wave in accordance with said generating step until pressure is acceptable; and moving said distribution network to a next location until said route from said mapping step is complete.

Various objects and advantages of the present invention will become apparent from the following description taken in conjunction with the accompanying drawings wherein are set forth, by way of illustration and example, certain embodiments of this invention. The drawings submitted herewith constitute a part of this specification, include exemplary embodiments of the present invention, and illustrate various objects and features thereof.

DETAILED DESCRIPTION OF THE INVENTION

Figure 1:
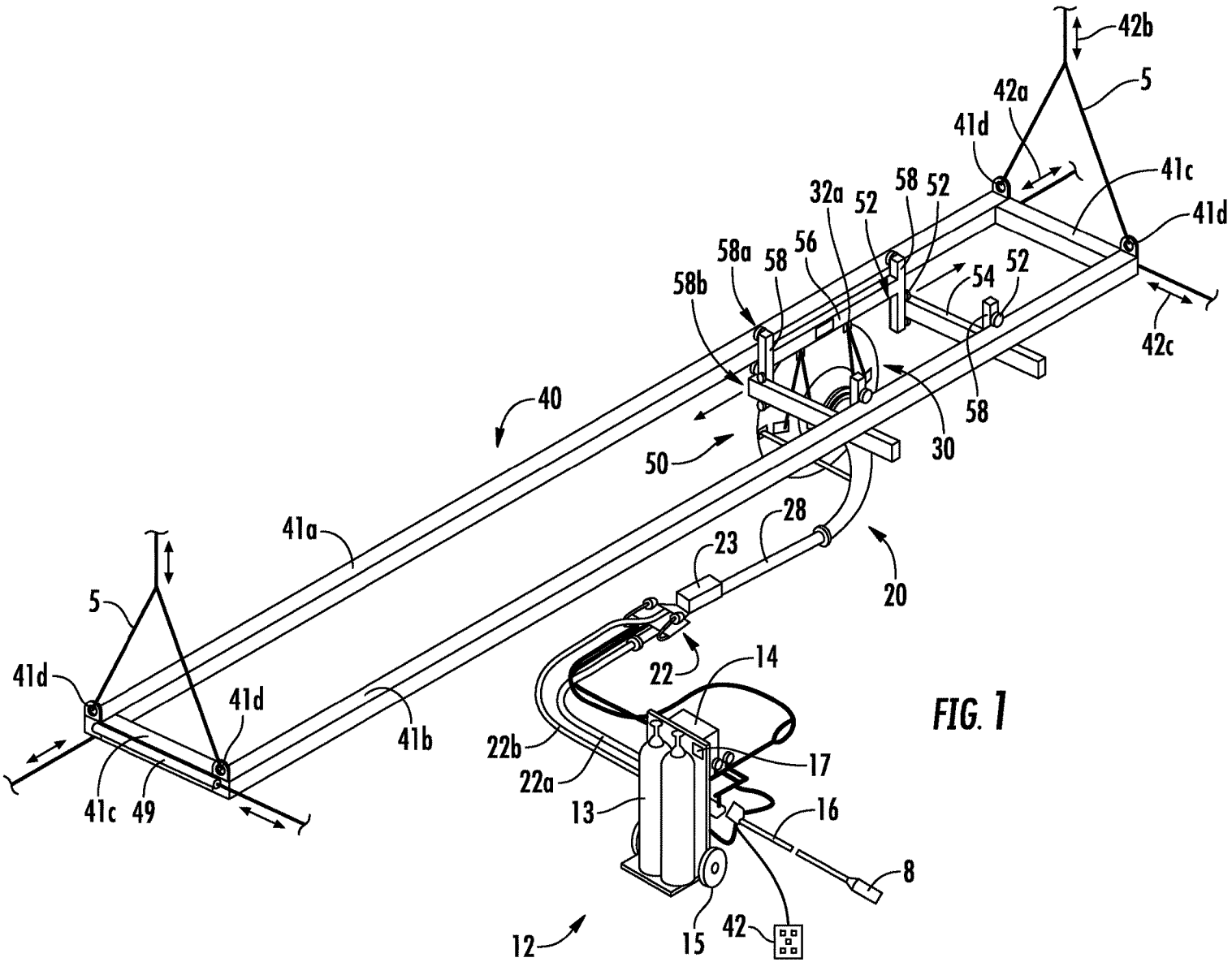
FIG. 1 is a perspective view of an embodiment of the mobile combustion cleaning system.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Generally, the mobile combustion cleaning system (generally referred to herein as reference number 10) and method 80 for practicing the invention referenced herein includes a mobile utility cart 12, a distribution network 20 and a navigation network 40 that provides an improved system for containing a combustion event while directing and focusing an impulse shockwave for an easier and effective off-line cleaning system and method for cleaning fouled heat exchange surfaces 4 a depth inward.

The distribution network 20 includes a cylindrical conduit 28 configured with at least one fuel inlet and one air inlet to supply a combustion mixture to the cylindrical conduit 28 for ignition by an ignitor 23 to produce an impulse wave. The impulse wave is accelerated into a detonation as it propagates downstream through the cylindrical conduit 28 and exiting through the exhaust 29 at a parabolic outlet 30. Generally, the exhaust 29 extends gradually from cylindrical conduit 28 to the parabolic outlet 30, with one end having a cylindrical shape and the opposite end having a more conical shape. The parabolic outlet 30 has a generally conical shape. Generally, the exhaust 29 starts to provide shape and directionality to the newly formed shockwave. The parabolic outlet 30 is used to aim the shaped shockwave onto the heat exchange surfaces 4. In an optional embodiment, a conical ring 31 encircles the parabolic outlet 30 and includes secondary injection ports 33 to allow additional combustible gas to be introduced during the cleaning cycle to enhance and improve the cleaning energy produced by the mobile combustion cleaning system 10. The detonation and corresponding high-pressure impulse waves are vented from the cylindrical conduit 28 and shaped and directed as they exit the exhaust 29 by the parabolic outlet 30 onto the heat exchange surfaces 4 for cleaning.

The distribution network 20 is guided through the cleaning process by the navigation network 40 which is adapted for supporting and transporting the distribution network 20 during the guided movement. In an optional embodiment, the distribution network 20 includes a rotating collar 34 which allows for rotation of the cylindrical conduit 28 about the parabolic outlet 30 for cleaning various sides along the outside perimeter of the heat exchange surfaces 4. The mobile combustion cleaning system 10 also includes a configurable controller 14 and navigation controller 42 for remote and continuous operation of the system 10 a distance from the utility room associated with the heat exchange surfaces 4.

Referring to the drawings in more detail, the reference numeral 10 depicted in FIG. 1 generally refers to an embodiment of the present invention, an improved impulse cleaning system which includes the mobile utility cart 12 with at least one gas storage vessel 13, a power supply 17, a configurable controller 14, pneumatic transmission lines 16 and with appropriate connectors for transmitting pressurized gas to the distribution network 20 which is supported by the navigation network 40 for movement along the heat exchange surfaces 4 as determined by the configurable controller 14 for cleaning the heat exchange surfaces 4.

Generally, the navigation network 40 is adapted for use within a utility room (not shown) containing the heat exchange surfaces 4 for assembly on site and transport through a door or opening (not shown) typically associated with the utility room, while supporting the distribution network 20 during movement during the cleaning process. In the depicted embodiment, the navigation network 40 allows for movement of the distribution network 20 along both the first and second axis 42*a*, 42*b*. Optionally, the navigation network 40 may allow for movement along a third axis 42*c*. In this way, the distribution network 20 may be moved up and down, side to side and back and forth within the utility room (not shown) during the cleaning process.

Figure 4:
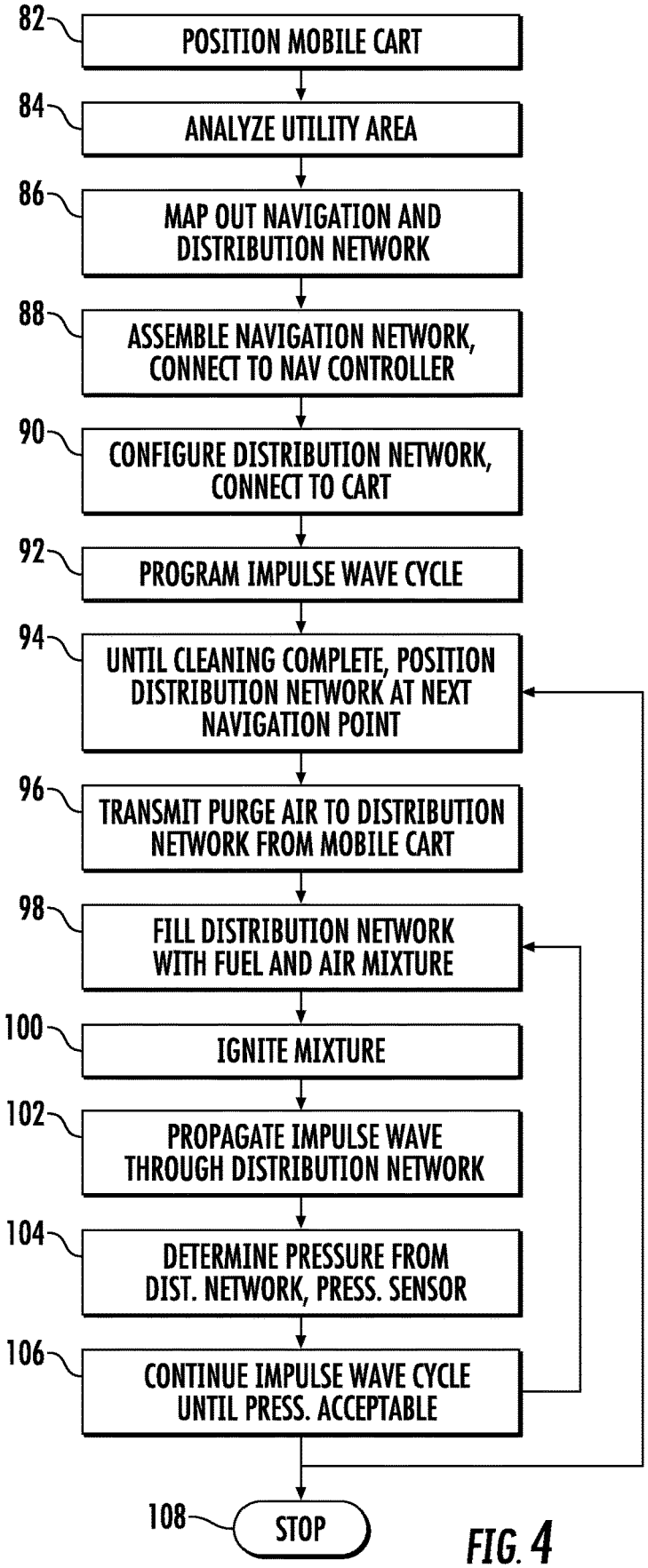
FIG. 4 is a process flow diagram illustrating an embodiment of an exemplary method for utilizing the mobile combustion cleaning system of FIG. 1.

The embodiment of the navigation network 40 illustrated in FIG. 1 generally provides for supported movement of the distribution network 20 during the cleaning of the heat exchange surfaces 4. The depicted embodiment of the navigation network 40 includes a plurality of support members configured to span the heat exchange surfaces 4 with a forward support member 41*a* spaced from a rearward support member 41*b* by a pair of lateral support members 41*c*. In the embodiment depicted in FIG. 1, vertical support is provided with a plurality of hanger supports 41*d* adapted for secure receipt of a cable, robe, chain or threadable support member which provides vertical support, typically attached to the utility room structure (not shown). The hanger supports 41*d* illustrated in FIG. 4 are attached at the four corners of the navigational network 40 and in receipt of a cable 5. Additional hanger supports may be provided as desired.

Optionally, the lateral support members 41*c* may include one or a pair of air actuators 44 which can be mounted to corner blocks between the forward support member 41*a* and the rearwards support member 41*b* along the lateral support members 41*c*. The air actuators 44 can be mounted in multiple directions for adjusting the spacing between the forward support member 41*a* and the rearward support member 41*b*. In the depicted embodiment the forward, rearward and lateral support members 41*a*, 41*b*, 41*c* are comprised of tubular steel, but could utilize other configurations and/or materials.

A trolley 50 is used for moving and supporting the distribution network 20 within the navigation network 40 and includes a plurality of rotational members 52 positioned along a rotational support members 56. The trolley 50 also proves at least a pair of receivers for securely receiving the distribution network 20 during movement along the navigational network 40. Generally, the navigation network 40 provides supporting members for movement of the distribution network 20, received by the trolley 50, including first axis support members for movement along said first axis and second axis support members for movement of the distribution network 20 along a second or third axis. The trolley 50 may be motorized or cable operated. The trolley 50 may include an electrical connection to the navigational controller 42 and can move along at least back and forth along the heat exchange surfaces 4 driven at least in part by at least one electric motor. An additional motor (not shown) may be operationally connected to the cable 5 for vertical adjustment of the navigational network 40 along the second axis 42*b*. The trolley 50 may be utilized in connection with one or two motors each of which is operationally connected to one of the rotational assemblies associated with the vertical supports 58.

Generally, the rotational support members 56, provide moveable support for the distribution network 20 during movement along a first axis 42*a*, and a second axis 42*b*. In general, the rotational support members 56 are depicted as being adapted for longitudinal movement along the forward and rearward support members 41*a*, 41*b*. Each of the rotational support members 56 present a pair of vertical supports 56*a* and may also include a receiver 32*a* such as a hook or other fastener for securely receiving the distribution network 20 for movement along the navigation network 40 during moveable operation.

The trolley 50 also includes a pair of side supports 54 spanning the rotational supports 56 for engagement by the forward and rearward support members 41*a*, 41*b*. Generally, the side supports 54 provide lateral support and the rotational supports 56 provide longitudinal support and in combination they provide for wheeled operation of the trolley 50 along a first and third axis 42*a*, 42*c*. In addition, the side supports 54 provide support to the distribution network 20 during the cleaning process. Optionally, the side supports 54 may include at least one telescoping brace (not shown) which extends between the forward and rearward support members 41*a*, 41*b* for alignment of the distribution network 20 and dampening or redirecting any rearwardly directed force resulting from the cleaning process.

As depicted in FIG. 1 each rotational support 56 includes a spanning member 56*b* separating the pair of vertical supports 56*a*, each of which is depicted with an upper assembly 58*a* separated from a lower assembly 58*b*. Generally, the upper and lower assembly 58*a*, 58*b* are adapted for rotational engagement as the trolley 50 moves laterally and longitudinally along the navigation network 40 for cleaning the heat exchange surfaces 4. Generally, the upper assembly 58*a* allows for movement longitudinally along the first axis 42*a* while the lower assembly 58*b* allows for movement laterally along the third axis 42*c* as the trolley 50 moves from one position to another position about the heat exchange surfaces 4 during the cleaning process. In one operational embodiment, both the upper and lower assemblies 58*a*, 58*b* allow for simultaneous movement along both the first and third axes 42*a*, 42*c*. To help determine the current position, the trolley 50 may include a position sensor and/or a visual sensor to help monitor the progress within the programmed route and determine the current location and to visually inspect the current location and surrounding area within the utility area. Position sensors may include a gps sensor or other known position sensors including a gyroscope.

The depicted embodiment of the upper assembly 58*a* includes a pair of rotational members 52 adapted for adjustable engagement with the navigation network 40 while the lower assembly 58*b*, depicted with a pair of rotational members 52, is adapted for adjustable engagement with the side supports 54. The engagement of the vertical supports 56*a* is depicted as being rotational in nature, alternatively, it may have suitable complementary structure for rotational or slidable engagement for movement of the distribution network 20 along the first and third axis 42*a*, 42*c*. In an operational embodiment, the lower and/or upper assemblies 58*b*, 58*a* may also include a mechanical or electrical rotational drive (not shown) in communication with the upper and lower assemblies 58*a*, 58*b* to assist in moving the trolley 50 as desired. The rotational drive (not shown), may be secured along the trolley 50 or secured to the navigation network 40 and using appropriate connecting members such as cables or chains for rotational operation of the upper and lower assemblies 58*a*, 58*b* for desired movement of the trolley 50.

Figure 2:
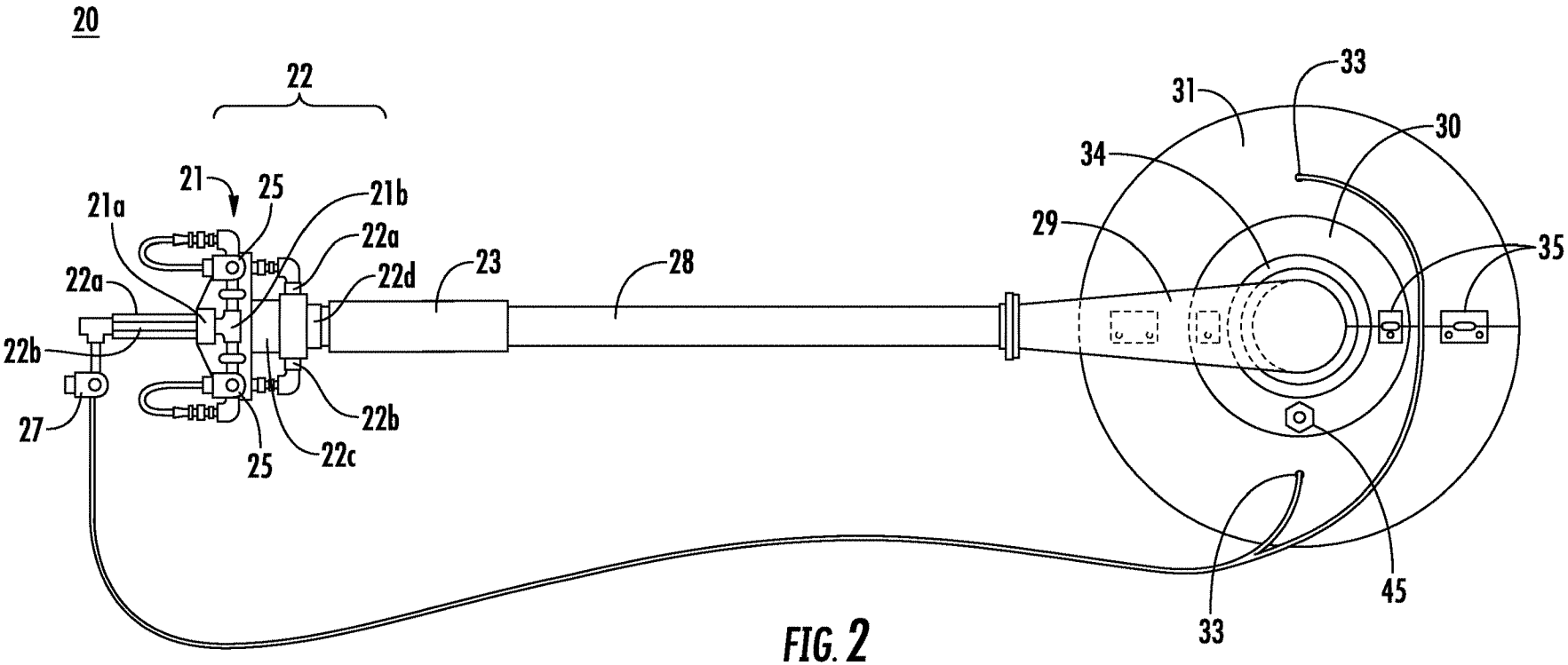
FIG. 2 is a top plan view of an embodiment of a distribution network.
Figure 3:
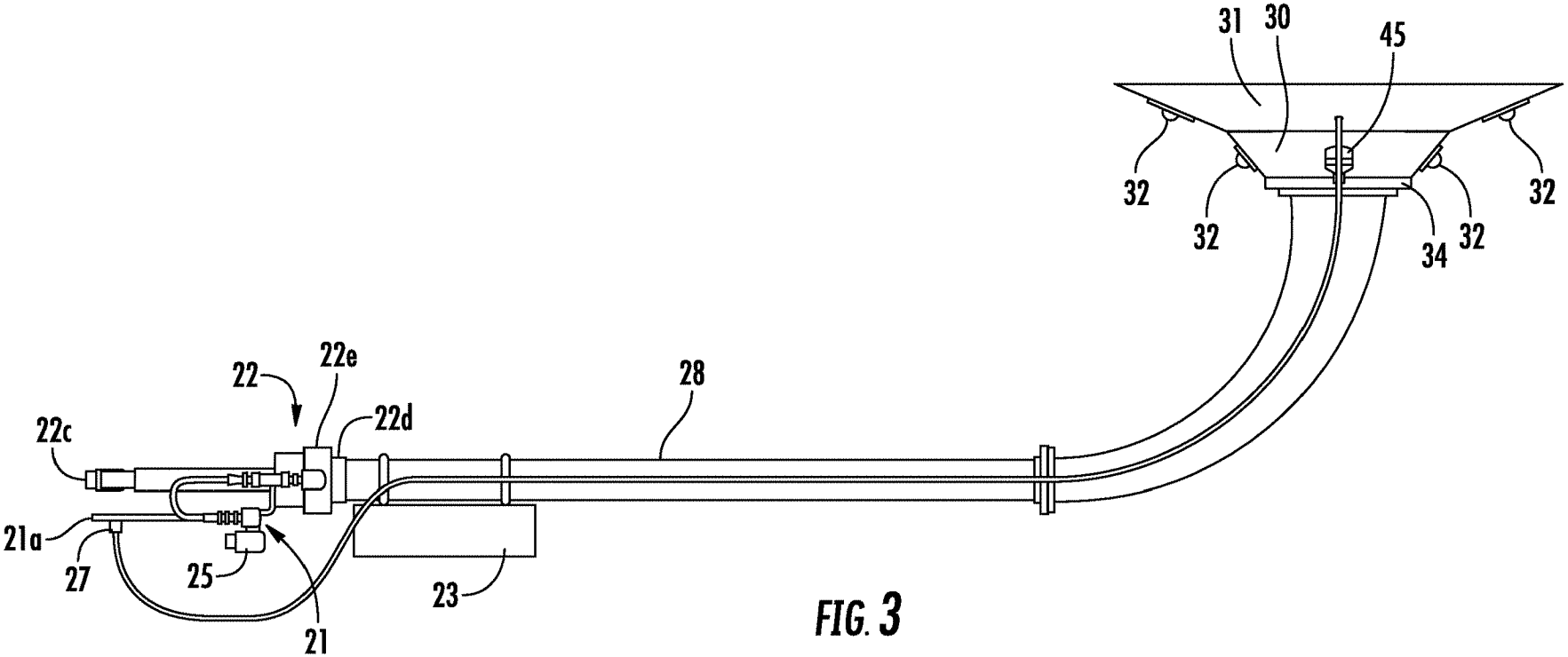
FIG. 3 is a side elevation of the distribution network of FIG. 2.

FIGS. 2-3 illustrates an exemplary embodiment of the distribution network 20. The distribution network generally receives gas and air from the mobile cart transmission lines 16 which are connectably secured to the mixing valve assembly 22 which also includes electrical connections to the configurable controller 14. Generally, the mixing valve assembly 22 in communication with the configurable controller 14 provides for receiving and mixing of the received gas and air at a desired mixture concentration at a desired rate for the desired combustion to clean the heat transfer surfaces 4. The configurable controller 14 may include various programmed parameters, like cycle duration, cycle rate, percentage of gas, number of cycles, length of cycles and desired pressure of each received gas, of the mixed gas and various feedback or alerts based on feedback sensors.

A navigation program may be entered into the configurable controller 14 which takes into account the horizontal and vertical measurements of the heat exchanges surfaces 4 as well as the measurement of the end of the distribution network 20 associated with the exhaust 29 and determine the appropriate or most efficient movement to complete the cleaning process along the horizontally and vertical axes. Once the desired movement is determined taking into account the preferred path, the configurable controller 14 can generate a movement command to the navigation network 40 at the appropriate time by transmitted to the navigation network 40 a movement command based on moving the distribution network 20 along the desired axes a distance based on the determined distance which includes the shape and size of the cylindrical conduit 28, exhaust 29 and outlet 30 and the dimensions of the heat exchange surfaces 4 along the first axis 42*a*, the third axis 42*b* and if desired, the second axis 42*c*. While the exhaust 29 associated with the distribution network 20 is depicted as a conical section and the outlet 30 is depicted as parabolic, other shapes and configurations may be utilized based on the desired movement of the navigation network 40, the available space within the utility area, the shape and dimensions of the heat exchange surfaces 4, the desired rotation of the distribution network 20 within the utility area, if any, and the desired shape and acceleration of the impulse shockwave, including but not limited to parabolic, hyperbolic, spherical, parallelogram, triangular, circular, square and polygonal or a combination of a portion of the same.

The mixing valve assembly 22 depicted in FIGS. 2-3 includes a multi-port manifold body 22*e* connected to a first inlet 22*a*, a second inlet 22*b*, a central inlet 22*c* in communication with an outlet 22*d*. The central inlet 22*c* extends rearwardly from the manifold body 22*e*, the first and second inlets 22*a*, 22*b* are oppositely spaced and the outlet 22*d* extends outwardly therefrom. In the depicted embodiment, the first and second inlets 22*a*, 22*b* are in communication with a transmission body 21 adapted for receipt of pressurized gas from the mobile utility cart 12.

The transmission body 21 includes a cylindrical inlet 21*a* connected to a T-shaped splitter 21*b* which extends to a pair of solenoids 25 in electrical communication with the configurable controller 14 and in operational communication the first and second inlet 22*a*, 22*b* whereby said solenoids 25 permit passage of the received gas through to the mixing valve assembly 22. The cylindrical inlet 21*a* is depicted with a smaller diameter cross-section adapted for receiving pressurized fuel, gas or some other hydrocarbon source. The central inlet 22*c* is depicted with a larger diameter cross-section consistent adapted for receipt of a pressurized air. Various pipe connections such as a T-shaped connectors, elbows, flexible tubing and threaded connections may be used to distribute the received air and gas to a mixing valve assembly 22 along with the pair of solenoids 25 which are each in electrical communication with the configurable controller 14 which allows for opening and/or closing of each solenoid 25 for selective transmission of the received gas in the desired ratio at the desired pressure and rate to the mixing valve assembly 22. As depicted in FIG. 3, the connection between the first and second inlets 22*a*, 22*b* includes a flexible conduit which extends towards opposite sides of the splitter 21*b*.

The outlet 22*d* extends from the mixing valve assembly 22 towards a cylindrical conduit 28. The cylindrical conduit 28 is generally cylindrical and hollow, extending from the mixing valve assembly 22 to the exhaust 30. An ignitor 23 is positioned along the cylindrical conduit 28 near the mixing valve assembly 22. The ignitor 23 is connected electrically to the configurable controller 14 and is adapted for the combustion processes and for transmission of the combustion mixture used for cleaning the heat exchange surfaces 4 outwards from the exhaust end 30 of the cylindrical conduit 28. Generally, the cylindrical conduit 28 includes an elongated combustion chamber for accelerating the ignited combustion mixture as it is transmitted through the cylindrical conduit 28 towards the exhaust 29 and out the parabolic outlet 30. In the depicted embodiment, the parabolic outlet 30 is configured for removal and assembly as a two-piece construction for easy set-up and removal in small areas or for passage through small doors or access areas, but it could be more or utilize a unitary construction as desired. In the two-piece construction, the parabolic outlet 30 may include a complementary structure with a pair of connecting tabs 35 which are adapted for integral receipt within a complementary receiving structure on the opposing section. The lifting lugs 32 depicted in FIGS. 2-3 are mounted on top of the connecting tabs 35 which may also help hide any underlying fasteners and present a seemingly smooth outer surface.

After the combustion mixture is ignited, it produces a high-pressure impulse wave which is directed and shaped by the parabolic outlet 30 to release deposits and debris from the heat exchange surfaces 4. The parabolic outlet 30 is depicted in FIGS. 2-3 as a conical two-piece section with the conical ring 31, a plurality of lifting lugs 32 spaced along the outer surfaces of the parabolic outlet 30 and the conical ring 31. Generally, the lifting lugs 32 are secured to the outer surfaces for supporting the distribution network 20 during movement within the utility room containing the heat exchange surfaces 4. In addition, the lifting lugs 32 allow the system to be guided and navigated throughout the cleaning process along the surface of the heat exchange surfaces 4. By way of example, a chain, rope, cable or interconnecting member can be used to support the distribution network 20 from the navigation network 40 by threading it through the lifting lugs 32 and around the receiver 32*a*. Both the parabolic outlet 30 and the conical ring 31 can be configured for two-piece design for improved mobility during transport and for assembly for use and disassembly when not in use. To assist in the two-piece configuration a plurality of connecting tabs 35 presenting an interlocking connection between the multi-piece design, including, but not limited to tongue and groove connectors. In this way, the improved mobile impulse cleaning system 10 can be easily inserted through a small access door and assembled inside the utility area.

The parabolic outlet 30, depicted in FIGS. 2-3 may also include a rotating collar 34 which allows for rotation between the cylindrical conduit 28 and the parabolic outlet 30. Rotation of the parabolic outlet 30 by the rotating collar 34 allows for improved operation within a narrow utility room or other confined space surrounding the heat exchange surface 4. In addition, a pair of injection ports 24 are illustrated in FIGS. 1-2 spaced along the conical ring 31 in communication with the pressurized gas through a secondary solenoid 27 for introduction of supplemental fuel to be introduced during the cleaning cycle to enhance and improve the impulse resulting from the combustion mixture for cleaning the heat exchange surfaces 4.

The parabolic outlet 30 depicted in FIGS. 2-3 also includes a pressure sensor 26. The pressure sensor 26, such as a pressure transducer, allows the system to capture, record, trend and monitory the pressure readings during the cleaning cycle to quantify and trend the cleaning effectiveness of the system during the cleaning cycle. For example, the pressure sensor 26 may record an initial pressure upon initiation of the cleaning cycle. During or upon completion of a programmed cleaning cycle, the system may then record a subsequent pressure and compare the subsequent pressure to the initial pressure. Depending on the differential pressure which determined by the configurable controller 14 of the system 10 in comparison to an input differential pressure value, the configurable controller 14 may indicate the system 10 needs to preform additional cycles, or the configurable controller 14 may indicate to the system 10 that the heat exchange surfaces 4 are sufficiently clean at the current location and command the navigation network 40 to move the distribution network 20 to the next location programmed into the configurable controller or alternatively, use a navigational controller 42 to provide manual control for movement of the distribution network 20 to the desired location. In this way, the system 10 cleans the heat exchanges surfaces 4 until the navigation program has concluded.

By way of example, the navigational controller 42 may be operably connected to the trolley 50 with a single or plurality of handheld controllers such as a multidirectional joystick or plurality of joysticks to control movement along the first, second or third axes 42*a*, 42*b*, 42*c*. In addition, a visual sensor 46 may be utilized along a structural member of the trolley 50 to visually inspect the heat exchange surfaces 4 and monitory movement of the trolley 50 during the cleaning process or during movement of the trolley 50 along the navigation network 40.

Figure 5:
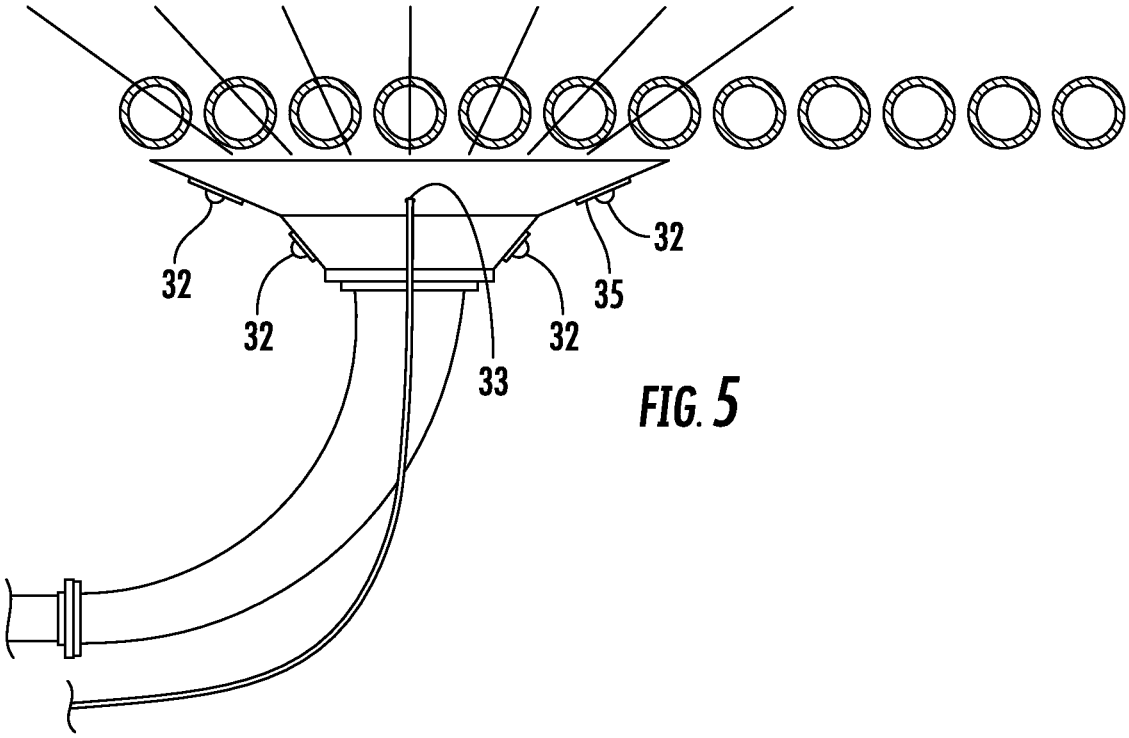
FIG. 5 is a side perspective view of a portion of the mobile combustion cleaning system illustrated in FIG. 1 associated with exemplary heat exchange surfaces.
Figure 6:
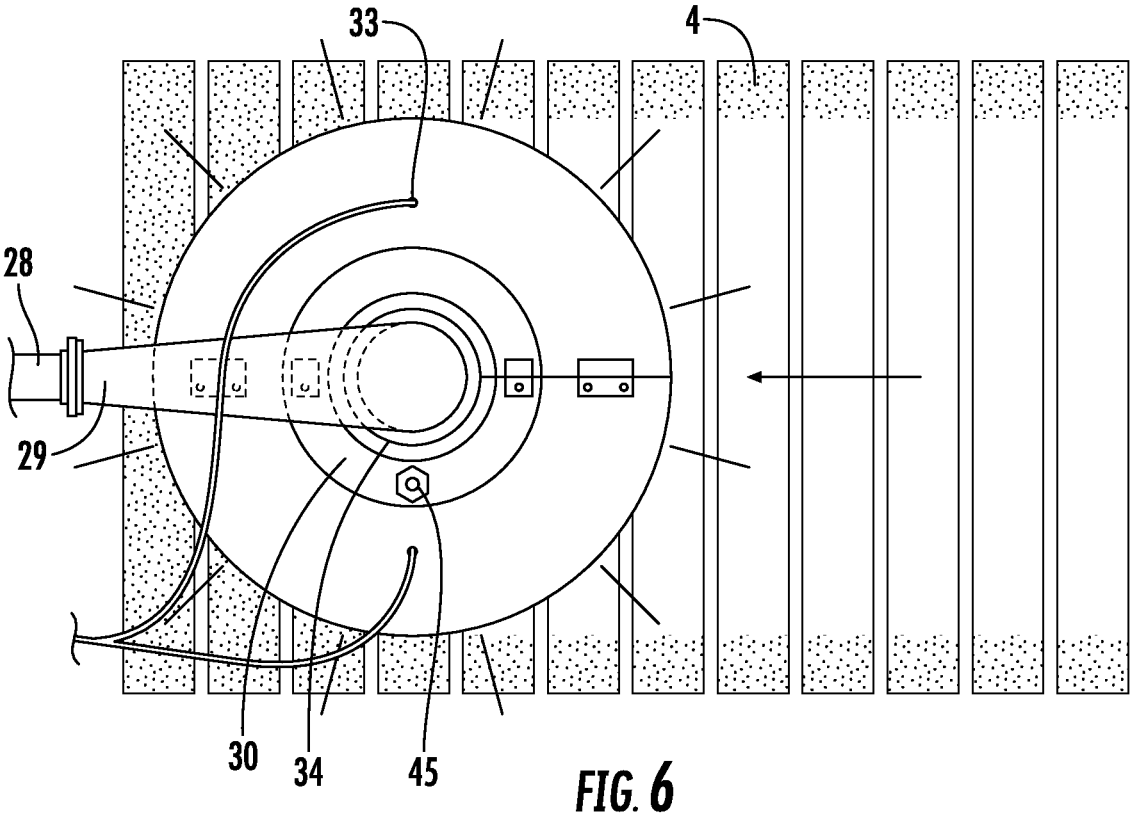
FIG. 6 is a top perspective view of the portion of the mobile combustion cleaning system illustrated in FIG. 5.

FIGS. 5-6 show the distribution network 20 with the parabolic outlet 30 traveling along the heat exchange surfaces 4 while cleaning surface debris a porous surface which is generally semi-permeable and allows for the passage of air therethrough. Once fouled, the heat exchange surfaces allows less air to pass through the material and thus the pressure at the surface is generally higher. Upon cleaning the debris from the heat exchange surfaces 4, at least a depth down, the pressure will become less. Using the pressure sensor 45, this pressure can be monitored and the differential can be programmed and stored into the configurable controller 14 as a way to monitor the effectiveness of the cleaning process.

An exemplary method 80 for practicing the current system 10, is illustrated in FIG. 4 with a mobile cart being positioned outside the utility area to be cleaned in step 82. The utility area is inspected at step 84 along with measurements of the shape and size of the heat exchange surfaces 4. Step 86 includes creating a navigation route for the navigation network 40 to traverse along the first and second axis 42*a*, 42*b* to clean the heat exchange surfaces 4 and the distribution network is configured with the navigation route being generated by the configurable controller 14 based on various parameters being provided through the configurable controller 14. Step 88 includes assembling the navigation network 40 and electrically connecting the navigation network 40 to a navigation controller 42 for manual control of the trolley 50. The distribution network 20 is then assembled and placed in communication with the mobile cart 12 with the gas and air lines operably connected at step 90. Once the navigation network 40 is installed and the distribution network 20 is configured and installed along the navigation network 40 and positioned for cleaning the heat exchange surface 4 at the initial position, the ignitor 23 is connected to the configurable controller along with any desired process sensors to monitor and provide any necessary system or process alerts. The desired impulse wave cycle program is determined and programmed into the configurable controller 14 and the impulse cycle is initiated at step 92. The impulse cycle is continued based on the provided program or until otherwise directed to stop or move to the next location as indicated in steps 94, 106 and 108. An exemplary impulse wave cycle is indicated in steps 96-106 with purge air being transmitted to the distribution network 20 at step 96. Filling the distribution network 20 with fuel and air to create the combustion mixture is indicated at step 98 which will involve activation of various solenoids 25 and ignition of the combustion mixture using the ignitor 23 at steps 98 and 100. The resulting impulse wave is propagated through the cylindrical conduit 28 of the distribution network 20 at step 102 and the pressure sensor 26 is monitored and recorded at step 104.

It is to be understood that while certain forms of the present invention have been illustrated and described herein, it is not to be limited to the specific forms or arrangement of parts described and shown.

What is claimed and desired to be secured by Letters Patent:

1. A mobile combustion cleaning system for removing debris from a plurality of semi-permeable heat exchange surfaces by transmitting a shaped impulse wave a depth into the semi-permeable heat exchange surfaces for removing debris, the system comprising:

a moveable distribution network extending from a mixing valve to an outlet, said mixing valve receiving a combustion mixture from a mobile cart according to a configurable controller;

an ignitor positioned between said mixing valve and said outlet and in electrical communication with said configurable controller whereby said ignitor generates said impulse wave from said combustion mixture;

said moveable distribution network configured for transmitting said impulse wave from said outlet onto said semi-permeable heat exchange surfaces;

a navigation network configured for secured receipt of said distribution network;

a navigational controller in operable communication with said navigation network for movement of said navigation network along a first axis, a second axis and a third axis;

said configurable controller configured for receiving and monitoring pressure data; and a navigation command sent from said navigational controller to said navigation network for movement of said distribution network along at least one of said first, second and third axes.

2. The mobile combustion cleaning system of claim 1 wherein said distribution network further comprises:

a cylindrical conduit extending from said mixing valve;

said ignitor being positioned along said cylindrical conduit for programmed ignition of said combustion mixture;

an exhaust extending from said cylindrical conduit; and said outlet extending from said exhaust and configured for shaping said impulse wave as it exits said distribution network.

3. The mobile combustion cleaning system of claim 2, said outlet further comprising a pressure sensor for measuring said pressure at said outlet.

4. The mobile combustion cleaning system of claim 2 wherein said outlet further comprises:

an annular ring; and at least one injection port for introducing a supply of pressurized fuel.

5. The mobile combustion cleaning system of claim 2 wherein said outlet further comprises:

a plurality of lifting lugs for supported receipt of the distribution network by the navigation network; and a plurality of connecting tabs for disassembly and reassembly of the outlet.

6. The mobile combustion cleaning system of claim 2 wherein said outlet is parabolic.

7. The mobile combustion cleaning system of claim 1 wherein said navigation network further comprises:

a trolley which moves along said first axis, second axis and third axis with rotational members and receivers for receiving the distribution network;

first axis support members for supporting the trolley as the distribution network moves along said first axis;

second axis support members for supporting the trolley as the distribution network moves along said second axis; and said trolley in communication with said navigational controller.

8. The mobile combustion cleaning system of claim 1 wherein said navigation network further comprises a trolley having a plurality of rotational members.

9. The mobile combustion cleaning system of claim 1 further comprising an injection port located near said outlet for transmission of said combustion mixture according to said configurable controller.

* * * * *